United States Patent [19]

Spronken

[11] Patent Number: 4,922,676

[45] Date of Patent: May 8, 1990

[54] CLOSURE AND SEAL FOR PREFABRICATED BUILDING PANELS

[76] Inventor: John R. Spronken, 95 Chelsea St., N.W., Calgary Alberta, Canada, T2N 3P9

[21] Appl. No.: 299,459

[22] Filed: Jan. 23, 1989

[51] Int. Cl.[5] ..... E04B 1/62; E04B 1/68

[52] U.S. Cl. ..... 52/396; 52/573

[58] Field of Search ..... 52/393, 396, 278, 573, 52/586, 460, 396, 573, 303

[56] References Cited

U.S. PATENT DOCUMENTS

| | | | |
|---|---|---|---|
| 3,065,574 | 11/1962 | Piana | 52/586 |
| 3,371,456 | 3/1968 | Balzer et al. | 52/278 |
| 3,390,501 | 7/1968 | Driggers | 52/396 |
| 3,456,407 | 7/1969 | Krah et al. | 52/396 |
| 3,512,819 | 5/1970 | Morgan et al. | 52/461 |
| 3,886,709 | 6/1975 | Krah et al. | 52/460 |

FOREIGN PATENT DOCUMENTS

| | | | |
|---|---|---|---|
| 251260 | 12/1966 | Austria | 52/460 |

*Primary Examiner*—James L. Ridgill, Jr.

[57] ABSTRACT

A closure and seal assembly is described for joining the edges of concrete structural panels. The arrangement comprises three main components, namely a pair of elongated pocket members each adapted to be embedded in a vertical corner of a concrete structural panel and an elongated spline member adapted to connect between the pocket members. Each pocket member has an inner pocket with an elongated opening slot and a pair of resilient sealing strips fixed to the edges of the slot and adapted to extend into the pocket. The spline has a web portion with T-flanges on the side edges thereof with the spline being adapted to be snugly held between the pocket sealing strips and the T-flanges being adapted to be held within the pockets.

2 Claims, 4 Drawing Sheets

CLOSURE AND SEAL FOR PREFABRICATED BUILDING PANELS

BACKGROUND OF THE INVENTION

This invention relates to building constructions and, more particularly, to a closure and seal arrangement for joining the edges of prefabricated structural panels, e.g. wall panels.

Many different types of prefabricated panels have been provided in the past to form walls of building structures. Some of these prefabricated panels have included insulation and others have included structures cast in the panels for attaching both interior and exterior finishing panels thereto.

Many examples of previously known pre-cast and otherwise constructed concrete wall panels are disclosed in U.S. Pat. Nos. 723,175, 984,517, 1,445,113, 1,617,033, 2,303,837, 3,466,825, 3,605,366, 3,605,607 and 4,112,626.

U.S. Pat. No. 3,371,456 describes an expansion connector for joining the edges of concrete building panels. This connector element is in the form of a plate member with stop members at the side edges. These stop members are provided to limit movement of the plate member outwardly through openings. While this connector provides a relatively good structural connection between the panels, it does not provide a good weather seal, particularly where very strong and cold winds are involved.

It is the object of the present invention to provide a closure and seal for joining the edges of prefabricated wall panels which will serve as an excellent weather seal against very strong and cold winds.

SUMMARY OF THE INVENTION

The present invention in its broadest aspect relates to a closure and seal for joining the edges of prefabricated wall panels. The arrangement comprises three main components, namely a pair of elongated pocket members each adapted to be embedded in or fastened to the edge of a prefabricated wall panel and an elongated spline member adapted to connect between the pocket members. Each pocket member has an inner pocket with an elongated opening slot and a pair of resilient sealing strips fixed to the edges of the slot and adapted to extend into the pocket. The spline has a web portion with T-flanges on the side edges thereof with the spline being adapted to be snugly held between the pocket sealing strips and the T-flanges being adapted to be held within the pockets.

The T-flanges may also be provided with downturned long free side edges and these free edges of the flange may also include outwardly projecting resilient sealing strips which engage the inner walls of the pocket. In this manner, a double seal is provided within the pocket.

According to another preferred feature of the invention, small holes are provided extending into the pockets to serve as pressure equalizing holes. This adds to the sealing effect of the sealing strips by ensuring that the closure and seal remain stable even if high pressure exists on the inside of the building.

The closure and seal assembly of this invention may be used for joining the edges of many different types of prefabricated wall panels, such as those made of concrete, steel, aluminum and combinations therof. With precast concrete panels, the assembly components may be embedded in edges of the panels during casting. Both vertical and horizontal edges may be joined with the assembly of the invention.

The assembly of this invention has the advantages of allowing for building movements without loss of sealing capacity and also prevents movement of air from either infiltration or exfiltration.

BRIEF DESCRIPTION OF THE DRAWINGS

The invention further consists in the novel arrangement, combination and construction of parts more fully hereinafter described and shown in the accompanying drawings. In the drawings.

DESCRIPTION OF THE PREFERRED EMBODIMENT

Figure 1:
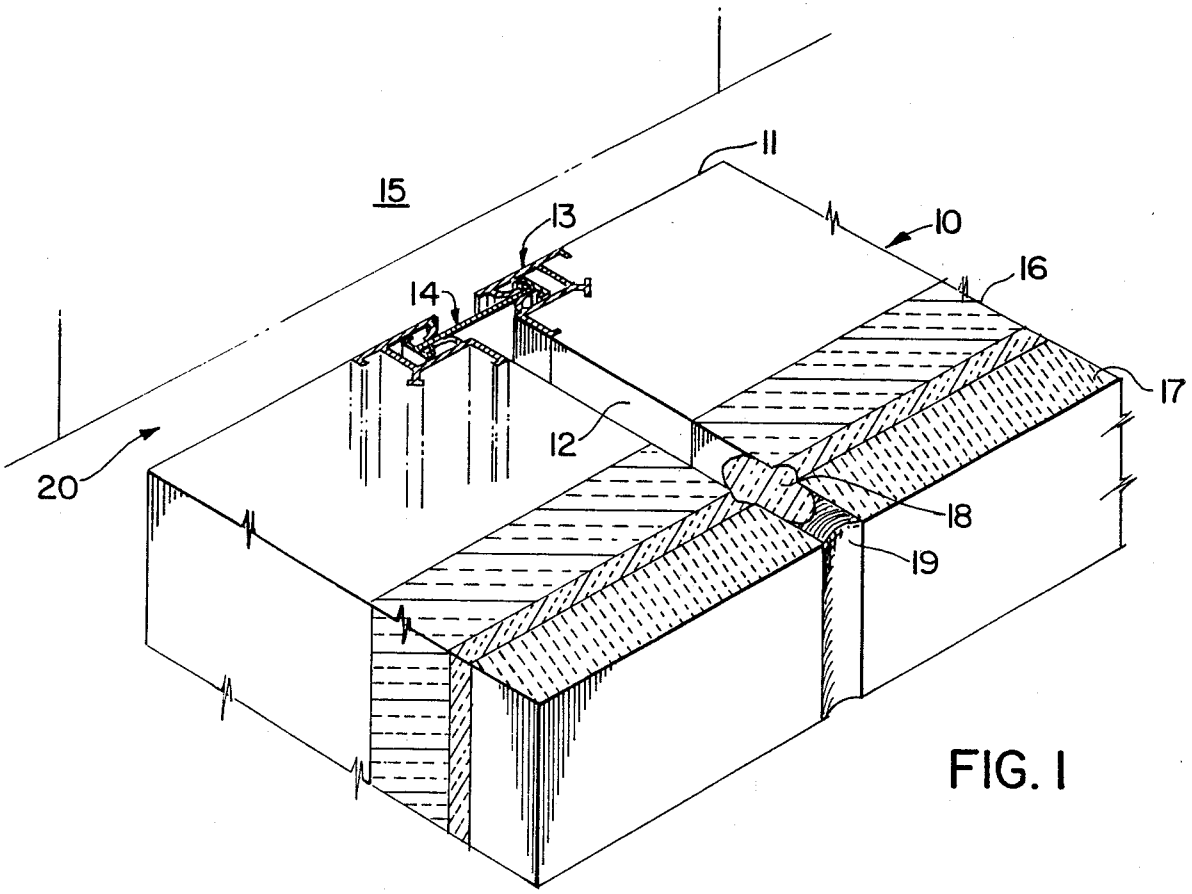
FIG. 1 is a perspective view showing the closure and seal arrangement of the invention in place in a concrete panel.
Figure 2:
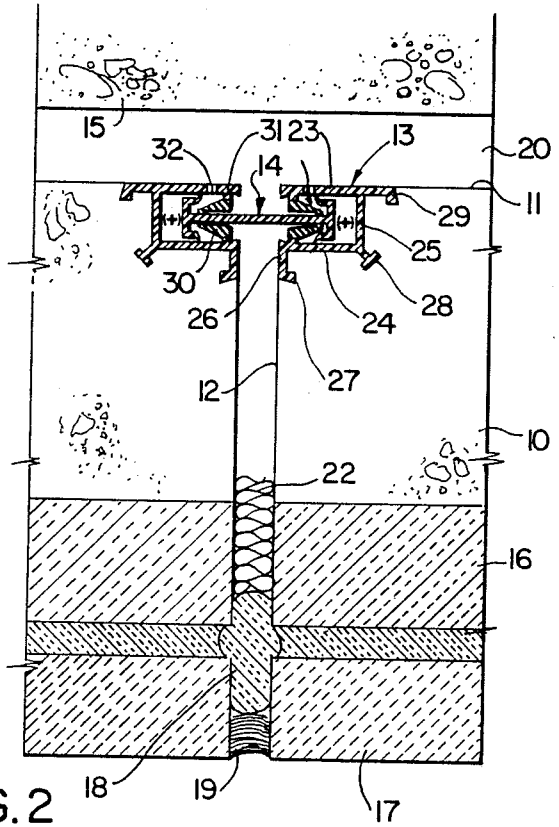
FIG. 2 a top plan view of the arrangement shown in FIG. 1.

As seen in FIGS. 1 and 2, a pair of pre-cast concrete panels 10 have inner side faces 11 and inner edge faces 12. Each panel has a pocket member 13 embedded in the vertical corner joining faces 11 and 12 and a spline 14 extends across between the pocket members 13.

This assembly is located adjacent a column or inner wall 15 with preferably an air gap 20 therebetween. In this particular embodiment, the outer face of each concrete panel 10 is covered by solid insulation 16 and a weatherproof exterior facing 17. An expansion gap is provided between the panels 10, insulation 16 and exterior facing 17. This gap is preferably filled by a foam plastic bead 18 and exterior caulking 19 and, if desired, is also filled with insulation 22.

Figure 3:
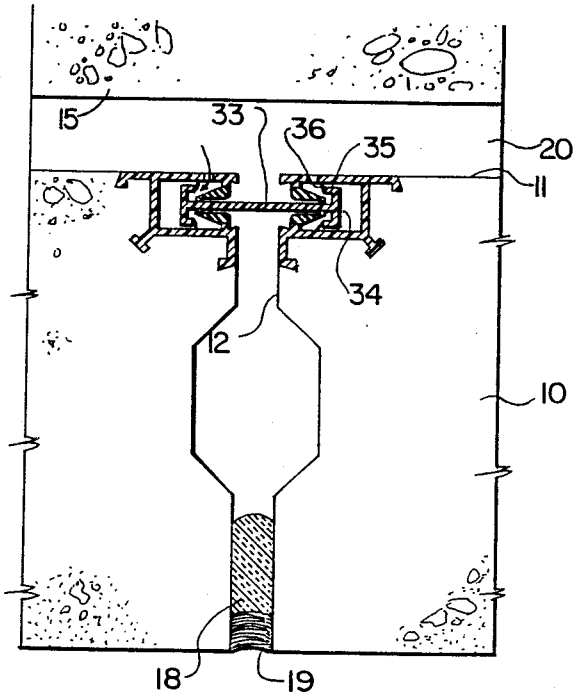
FIG. 3 is a top plan view of an alternative form of panel.

Details of the closure and seal arrangement can be best seen from FIGS. 2 and 3 and it will be seen that the pocket member 13 includes an exterior side panel 23, an interior side panel 24, an interior end panel 25 and an exterior end panel 26. Anchors 27, 28 and 29 are preferably provided for firmly anchoring the pocket member 13 within the concrete panel 10. At the exterior end of the pocket, a pair of strips 31 provide a slot therebetween and mounted to the free edge of each strip 31 is a resilient sealing strip 30. These sealing strips 30 extend inwardly towards each other and firmly grip the spline 14 therebetween.

The spline 14 includes a web portion 33 with edge T-flanges 34. These flanges 34 preferably include downwardly turned edges 35 with resilient strips 36 connected thereto. These resilient strips are directed outwardly to engage the inner faces of the side panels 23 and 24, thereby providing additional sealing against wind.

Small vent holes 32 may be provided in exterior side panels 23 of the pockets 13. These holes are positioned to open into the gap between the resilient strips 30 and 36 and serve to equalize pressure. This adds to the sealing effect of the sealing strips by ensuring that the closure and seal remain stable even if high pressure exists on the inside of the building.

The embodiment of FIG. 3 is quite similar to that of FIG. 2, the main difference being that FIG. 3 shows a construction with only the pre-cast concrete panels 10 and no insulation or outer facing. In terms of the present invention, the embodiment of FIG. 3 functions in the same manner as that of FIG. 2.

Figure 4:
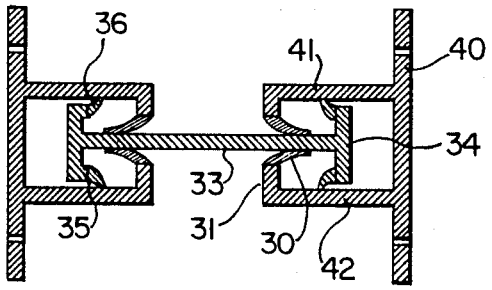
FIG. 4 is a sectional view of a closure and seal arrangement of the invention for connecting to panel edges.

The closure and seal arrangement shown in FIG. 4 is intended for attaching to a flat panel surface rather than embedding into a concrete panel. For instance, it may be used for sealing between a prefabricated panel and a main structure.

The embodiment of FIG. 4 provides a support flange 40 for fastening to a panel face and this support flange 40 has a pair of outwardly projecting legs 41 and 42 forming therebetween a pocket. The outer ends of legs 41 and 42 have inwardly projecting strips 31 to which are connecting resilient sealing strips 30.

The pockets are joined by a spline 14 of the type previously described. This includes a web portion 33 with edge T-flanges 34, which include downwardly turned edges 35 and resilient strips 36 connected thereto.

Figure 5:
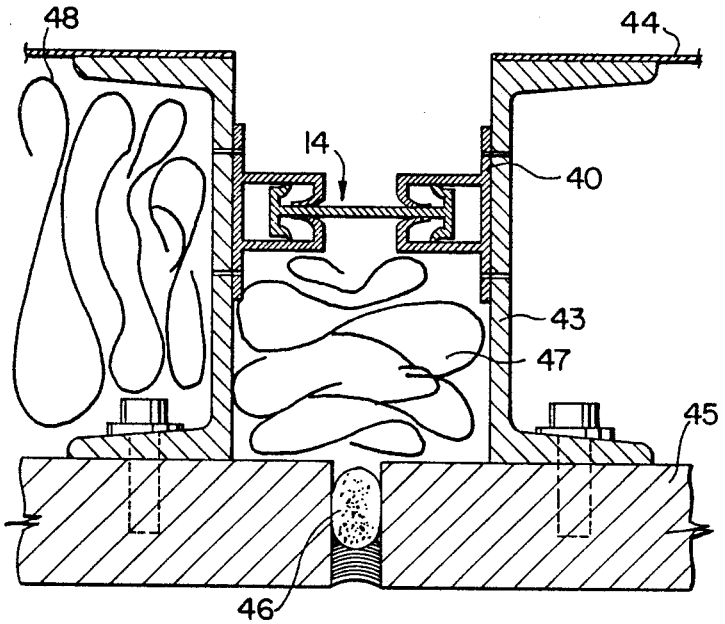
FIG. 5 is a sectional view showing the arrangement of FIG. 4 attached to adjacent panel edges.

This assembly is shown in place in FIG. 5 with the connector flanges 40 mounted on structural channel members 43. These channel members 43 are mounted between a weatherproof exterior facing 45 and an interior facing 44. The space between exterior facing portion 45 may be filled by a foam plastic bead 18, while the space between the channel members 43 may be filled by insulation 47 and further insulation 48 may be provided between the inner and outer wall panels.

Figure 6:
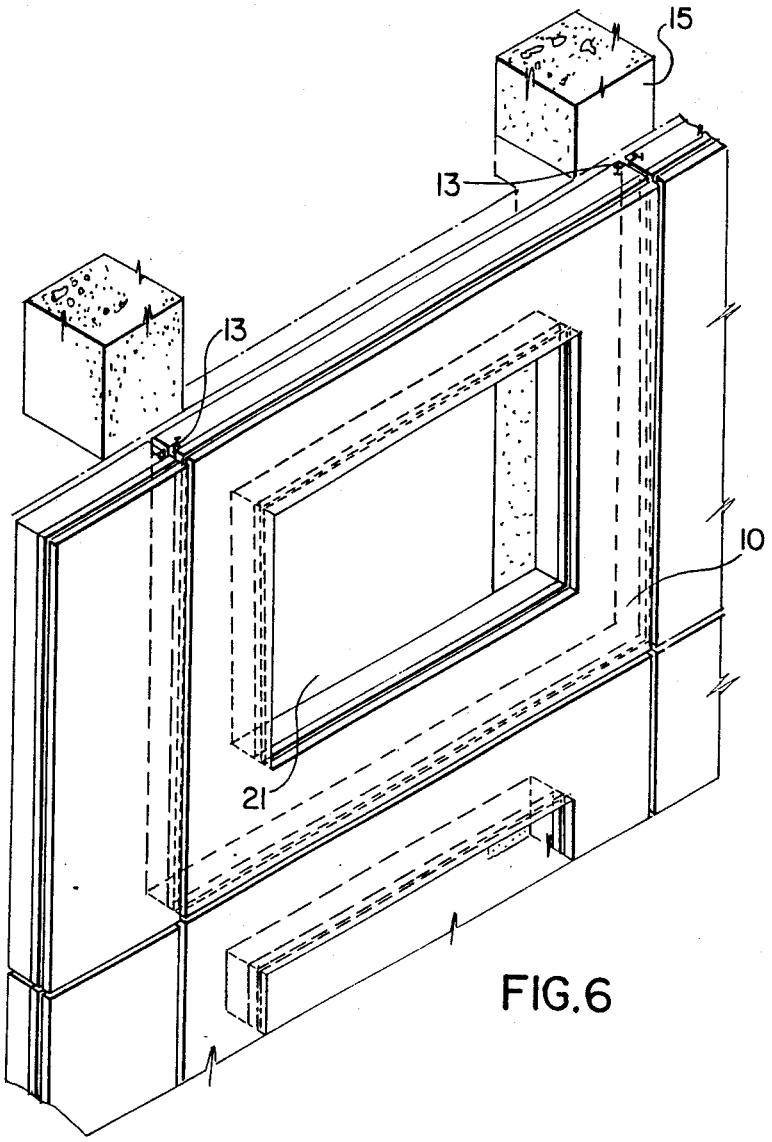
FIG. 6 is a perspective view of a wall assembly.

An example of the complete assembly is shown in FIG. 6 and here each pre-cast concrete panel 10 is provided with a window opening 21. It can also be seen from FIG. 6 that the closure and seal pockets 13 can be positioned at either the inner or outer face of the precast concrete panel 10. However, it is generally preferred to position them adjacent the inner face as shown at the right hand side of FIG. 6.

While several specific forms of the invention have been shown and described, it is to be understood that I am to be limited only to the scope of the following claims.

I claim:

1. A closure and seal assembly for joining the edges of prefabricated wall panels comprising:

(a) a pair of elongated pocket members each adapted to be embedded in or fastened to a face of a prefabricated wall panel, each pocket member having inner and outer side walls and inner and outer end walls with said outer end wall containing an elongated opening slot and a pair of resilient sealing strips fixed to the edges of said slot and adapted to extend into the pocket and at least one vent hole extending through at least one side wall and (b) an elongated spline member adapted to connect between the pocket members, said spline comprising a web portion with T-flanges on the side edges thereof and resilient sealing strips projecting outwardly from free edges of the T-flanges, the spline being adapted to be snugly held between said pocket sealing strips and said T-flanges being adapted to be held within the pockets with said T-flange resilient sealing strips being adapted to sealingly engage the side walls of said pocket.

2. An assembly according to claim 1 wherein each pocket member is permanently anchored in a corner of a pre-cast structural panel.

* * * * *